United States Patent [19]

Goldstein et al.

[11] Patent Number: 5,062,551

[45] Date of Patent: Nov. 5, 1991

[54] POSTLESS PUSHUP CONTAINER

[75] Inventors: Charles Goldstein, Ramapo Township, Rockland County, N.Y.; Kenneth P. Glynn, Raritan Township, Hunterdon County, N.J.

[73] Assignee: Delta Dispensing, Inc., Flemington, N.J.

[21] Appl. No.: 596,785

[22] Filed: Oct. 1, 1990

[51] Int. Cl.[5] ..... B67D 5/42

[52] U.S. Cl. ..... 222/390; 74/89.2; 74/128; 74/424.6; 74/501.5 R; 222/391; 222/392

[58] Field of Search ..... 222/390–392; 74/501.5, 424.6, 128, 89.2, 89.21; 401/172, 174, 179, 182; 604/209, 224

[56] References Cited

U.S. PATENT DOCUMENTS

| | | | |
|---|---|---|---|
| 631,078 | 8/1899 | King . | |
| 1,810,249 | 6/1931 | Koehler . | |
| 2,240,046 | 4/1941 | Marra | 222/391 |
| 2,272,641 | 2/1942 | Mureau | 222/390 X |
| 2,402,072 | 6/1946 | Nehrke | 222/392 X |
| 2,541,949 | 2/1951 | Thacker et al. | 222/391 X |
| 2,547,657 | 11/1951 | Pierce | 74/424.6 X |
| 3,229,865 | 1/1966 | Heisler et al. | 222/391 |
| 4,318,499 | 3/1982 | Hamilton | 222/391 X |
| 4,479,592 | 10/1984 | Rüsing et al. | 222/391 X |
| 4,793,521 | 12/1988 | Steiner | 222/390 X |

FOREIGN PATENT DOCUMENTS

| | | | |
|---|---|---|---|
| 3513880 | 10/1986 | Fed. Rep. of Germany | 222/392 |

*Primary Examiner*—Kevin P. Shaver

*Attorney, Agent, or Firm*—Kenneth P. Glynn

[57] ABSTRACT

The present invention is directed toward a material dispensing container that uses a flexible band to drive a piston within a storage container. The band is so formed so that it can be easily wound or folded within a small area at the bottom of the storage container. The band is connected to a piston within the container, and the movement of the band forces materials stored above the piston to be dispensed through any dispensing orifice at the top of the container. The band drives the piston by being forced through a tapered conduit. The passage of the band through the conduit, orients the band and causes the band to loose some of its flexibility. The stiffened band is then used to drive the piston. The passage of the band through the tapered conduit also orients the band so that extensions, stemming from the band, can be engaged and forwardly advanced by the user.

14 Claims, 6 Drawing Sheets

POSTLESS PUSHUP CONTAINER

BACKGROUND OF THE INVENTION

1. Field of the Invention

The present invention is directed toward a material dispensing container, and more particularly to such containers that hold solid, semi-solid, or liquid materials and allow those materials to be dispensed by the forces created on a piston by a foldable segmented band.

2. Prior Art Statement

Containers with moveable pistons have been used to dispense materials for centuries, and over the years dozens of different technologies have been developed to move such pistons. When piston containers are used to store a solid material, often a solid shaft is threaded through the piston, and the piston is moved back and forth within the container by turning the threaded shaft. However, when semi-solid or liquid materials are stored in a container, often a threaded shaft can not be used because of possible leakage and/or contamination. Thus, the integrity of the material storage volume must be maintained. In these applications, methods of moving the piston within the container were developed that would not interfere with the stored material nor cause a great deal of space within the container to be dedicated to the piston movement device.

One of the first such inventions was U.S. Pat. No. 631,078 to King. The King patent shows a piston attached to a string in a pulley orientation. As the string is pulled the piston is forced to rise, thus dispensing a material stored above the piston. Another early technology for moving materials stored within a container is exemplified by U.S. Pat. No. 1,810,249 to Koehler and U.S. Pat. No. 2,402,072 to Nehrke. Both patents show materials moved by the relative movement of a flexible track attached to the bottom supports of the stored materials. As the tracks are moved downwardly on the outside of the container, the track on the inside of the container is forced upwardly, transporting the attached material supports. A similar technology is shown in U.S. Pat. No. 3,229,865 to Heisler et al. In the Heisler patent a flexible track is stored on the outside of a container, as the track is forced into the container, the piston, which is attached to the end of the track, is forced upward.

A more modern technology used to move pistons within containers, uses a segmented flexible track member to push the bottom of the piston. Such devices are exemplified by U.S. Pat. No. 4,318,499 to Hamilton. In the Hamilton patent the segmented track is stored in a serpentine orientation, minimizing the space needed within the container. The segmented track is propelled forward by the mechanical engagement of one segment at a time, transferring the applied mechanical force directly to the pistons base. The present invention also uses a flexible segmented track that is propelled forward by mechanically engaging one segment of the track at a time. However, in the present invention, the track is either preformed into segments that independently support one another, or the track is formed in a flat orientation that is transformed into a usable form just prior to the tracks engagement with a mechanical drive means. Both embodiments minimize the space within a container that must be dedicated to the storage of track. And both embodiments eliminate the need for track supporting, because the orientation of the present invention tracks prohibit buckling or bending of the tracks when the tracks are under compression. Consequently, the track can be stored in many bent orientations when not used, but once put to use in advancing the piston, the tracks orientation makes the track become rigid under the compression force of the resisting piston. This minimizes the space needed to store the track when not being used, and eliminates the need of a track support when the track is in use.

Thus, although prior art does show the use of segmented track driven pistons, prior art does not teach nor suggest the technology described by the present invention in the attached specifications or appended claims.

SUMMARY OF THE INVENTION

The present invention is directed toward a material dispensing container that uses a flexible formable segmented band to drive a piston within a storage container. The flexible band can be formed into two primary shapes. The first embodiment is a flexible band that has a plurality of segments, each segment with a plurality of rigid depending side walls. The rigid side walls on the segmented band allow the band to bend only in the direction opposite the depending side walls. This bendability allows the band to be stored in a wound orientation thus minimizing the space within the container dedicated to the storage of the band. When the band is used, it is passed through a conduit that orients the band to a line perpendicular to a movable piston within the container. The band is advanced by a mechanical drive means, and the forces created between the piston and the drive means causes the band to be compressed. While under compression the depending side walls of the segments on the band engage one another causing the band to become rigid. The rigid orientation allowing the full force of the mechanical drive means to be directly transferred to the piston, forcing the piston upward.

The second embodiment of the flexible band is a band of flexible material that has a plurality of evenly distributed side wall members depending from at least one of its side edges. When unstressed, the side wall members of the band lay in the same plane as the main body of the band. However, when the band is forced through a tapered conduit, the side wall members are deflected into an orientation substantially perpendicular to the main body of the band. The perpendicularly extending band side wall members engage a mechanical drive means operated by the invention's user. The mechanical drive means forces the band through the tapered conduit, thus forcing more of the band's side wall member to take a perpendicular orientation. The formed end of the band leaving the tapered conduit is attached to the base of a piston. So as the band is driven through the tapered conduit the piston is forced upward, propelling forward any materials stored above it. The formable flexible band allows a large length of band to be stored in a small area. The normal flat orientation of the band, allows the band to be folded over or wound around itself many times over, thus needing only a small area within a storage container to be dedicated to a piston drive means.

Both embodiments of the flexible band have the characteristics of being storable in a wound or folded orientation when not in use, and being rigid when compressed while in use. The present invention orients these bands and provides a means of engaging and advancing these bands so as to provide a moving force to a piston while minimizing the space needed to store and operate such a piston advancement mechanism.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE INVENTION

Figure 1:
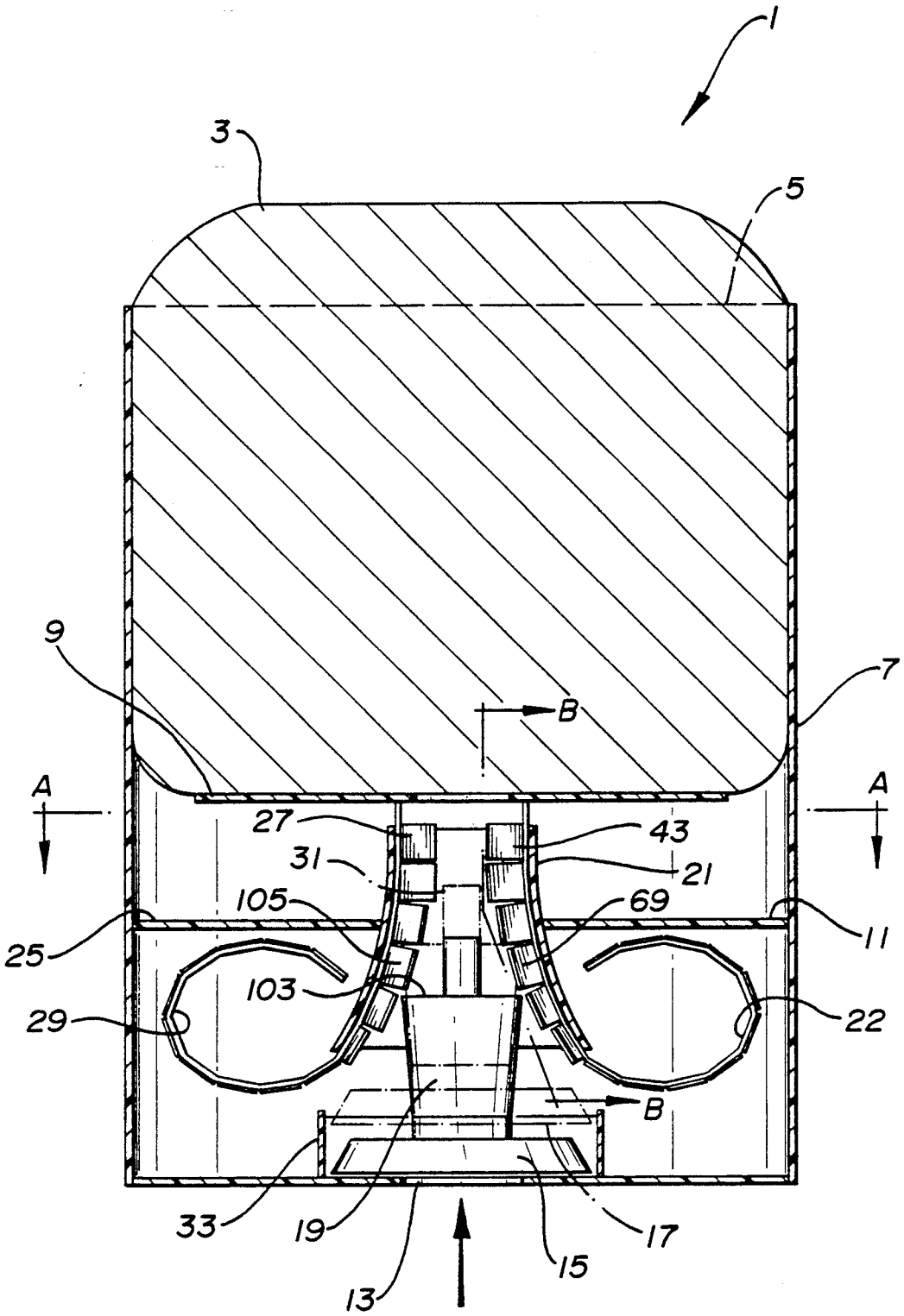
FIG. 1 shows a fragmented forward view of one preferred embodiment of the present invention.

The present invention is, as mentioned, directed towards a material dispensing container and device that uses a flexible formable segmented band to drive a piston and dispense material from within the container. Piston driven dispensing containers have been in existence for centuries. And all related technologies developed in that field over the years have experienced the same design problem, how to drive the piston without dedicating a large portion of the dispensing container to a piston drive mechanism. Prior to the present invention pistons were driven by bands that had preformed three dimensional extensions or reliefs formed thereon. The band extensions or reliefs provided a medium through which a mechanical drive means could engage and advance the band. Such preformed bands were difficult to store within dispensing devices. The preformed extensions, or the material needed to support reliefs, prevented the bands from being efficiently wound or folded. The result was a band that took a large area to store, thus limiting the volume within a dispensing container that could actually be used to store materials.

The present invention solves the problem of piston drive band storage by creating a band that is flexible when unstressed, and rigid when used to drive a piston. The flexibility of the present invention band, before use, allows the band to be easily folded or wound upon itself or around a storage spool. Through this procedure a very long length of band can be stored in a very limited area. Additionally, the present invention saves container space by having piston drive bands that are self-supporting and need no guide means. In the past, segmented piston drive bands had the same flexible characteristics during use, as they did when stored. The present invention piston drive band orients its component parts to become rigid when compressed. Thus, as the piston drive band is forced against the piston, the resulting compression causes the band to become rigid eliminating the need for extra support and reducing the space needed to drive the band.

The present invention piston drive band comes in two primary orientations. The first orientation is a formable flat band. The flat band allows the band to be easily stored when not used. The flat orientation is easily folded or wound around a spool, allowing a very long length of band to be stored in a very limited area. However, the present invention flat band design changes its orientation from a two dimensional configuration to a three dimensional configuration when the band is stressed. The flat band is forced through a tapered conduit. The sloping walls of the conduit, turn the sidewall members of the flat band, so that the sidewall members exit the tapered conduit substantially perpendicular to their prior orientation. The turning of the bands side walls, create a three dimensional surface that can easily be engaged by a mechanical drive means. The mechanical drive means being a single stroke plunger or a geared orientation formed to match the pitch of the bands side wall member's spacing. The mechanical drive means, pulls the band through the tapered conduit, thus causing more and more of the band to change in shape. Therein the mechanical drive means is creating the very surface that it is engaging. The reshaped band exiting the tapered conduit is attached to the bottom of a piston. The new shape of the band prevents the band from buckling or folding during compression, and as the band is advanced, the piston is driven within the dispensing container. Consequently the materials suported by the piston are advanced until the stored materials come to the dispensing end of the container.

The second orientation of the band used within the present invention is a preformed segmented band that has rigid walls depending from the peripheral edges of every segment. When the band is bent over in the direction of the depending side wall members, the side wall members of adjacent segments interfere with one another, preventing the band from bending further. The result is a band that is bendable only in one direction, away from the side wall members. The one way bendable band allows the band to be wound around itself, or a spool, thus allowing a large length of band to be stored in a small area. When the band is used it is forced through a conduit by some mechanical drive means. The mechanical drive means engages at least one side wall member of each band segment and either pushes or pulls the band through the conduit. The conduit orients the band so that it becomes linear and perpendicular to the piston within the container. As the band pushes the piston, the linear orientation of the band is compressed forcing the side wall members of each segment to engage the adjacent segment. The result is a rigid band through which forces provided by the mechanical drive means can be directly transferred to the piston, advancing the piston and dispensing any materials above it.

Referring now to FIG. 1 a partially cross-sectioned side view of one preferred embodiment of the present invention 1 is shown. The invention 1 consists of a hollow container 7 partially filled with a manufactured product 3. The manufactured product 3 is resting upon a piston 9, and the piston 9 drives the manufactured product 3 out through the dispensing end 5 of the container 7. The inside walls of the container 7 support a tapered conduit 21 via support extensions 11 and 25. At the base of the container 7 there is an orifice 13, through which a plunger 19 can be accessed. The plunger 19 has an extended base 15 guided by container support 33. Within the tapered conduit 21 are two formable flexible band 22 and 29.

Figure 2:
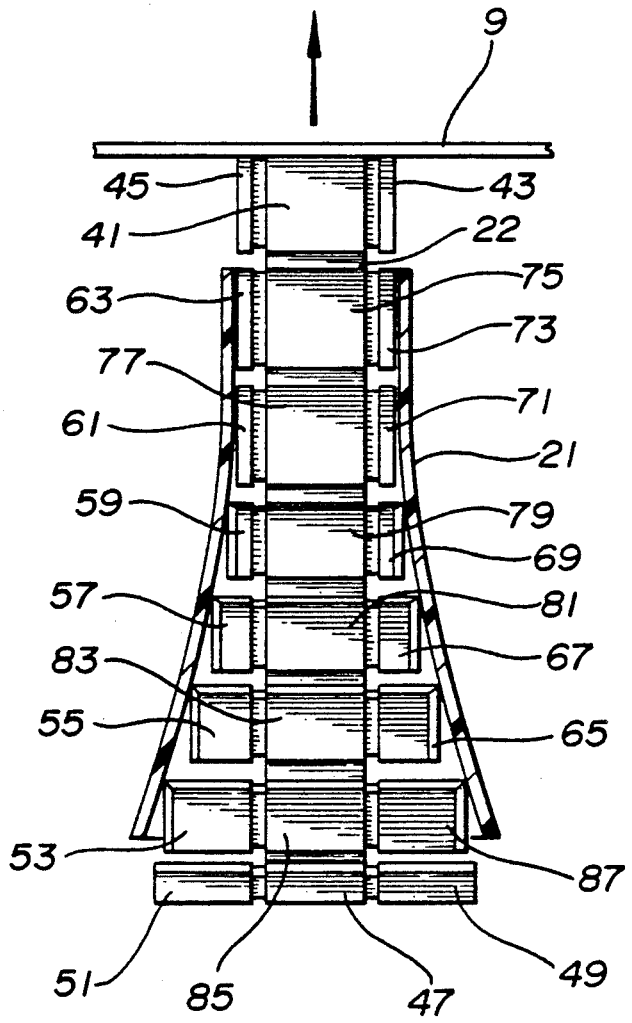
FIG. 2 shows a fragmented front view of sectional cut B—B as indicated in FIG. 1.
Figure 3:
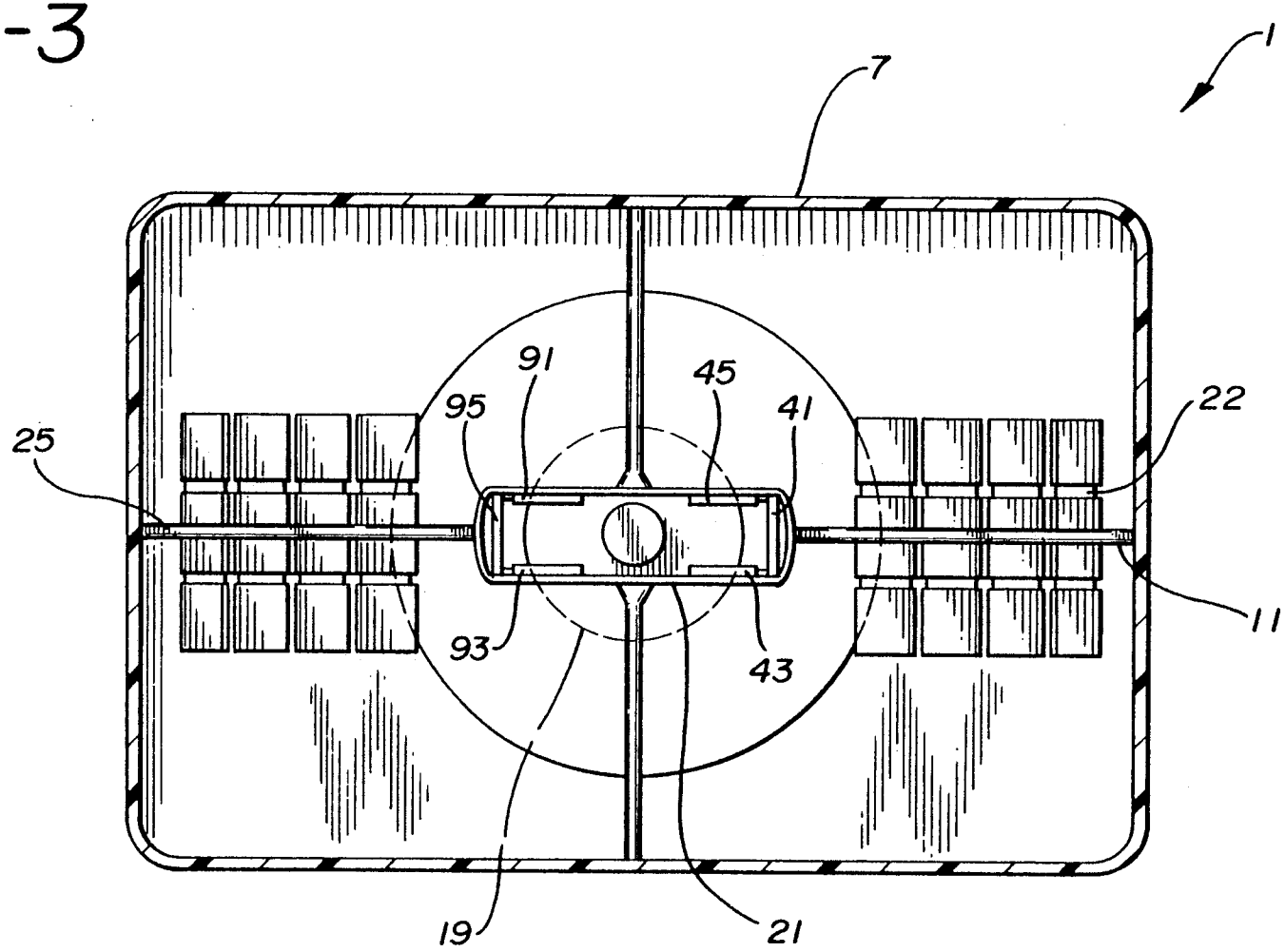
FIG. 3 shows a top cross-sectional view cut along line A—A as indicated in FIG. 1.

To understand the functioning of the flexible band 22, 29 it is best to refer to FIGS. 1, 2 and 3 simultaneously. FIG. 2 is a side view of the band 22 passing through tapered conduit 21 as viewed from cut line B—B of FIG. 1. As shown from FIG. 2, the band 22 is segmented, each segment with a base and two side wall members. As shown, before the band 22 enters the tapered conduit 21, the side wall members 51 and 49 are in a linear orientation with their dependant base 47. As the band first enters the tapered conduit, the base 85 remains linear but the side wall members 53 and 87 begin to bend, pivoting at their connections with the base 85. The side wall members 55 and 65, 57 and 67, 59 and 69, 61 and 71, and 67 and 73 continue to bend following the shape of the conduit 21 until the band 22 emerges from the small conduit end with the side wall members 43 and 45 are perpendicular to their base 41. Looking now to FIG. 3 the cross-sectional top view of cut A—A is shown, and the perpendicular orientation of base 41 and side members 45, 43 is clearly shown. Also, the shape of the tapered conduit 21 is more clearly defined showing how the shape of the conduit 21 would form the band 22 from its flat orientation before entering to its perpendicular orientation upon exiting.

Although FIG. 3 shows a tapered conduit 21 that has a rectangular shaped top orifice, it should be understood that the function of the tapered conduit 21 is to orient the segments which construct the flexible formable bands 29, 22. The tapered conduit 21 could orient the flexible bands 29, 22 by having an oval shaped exit orifice instead of the rectangular formation shown and the effect of the tapered conduit 21 on the flexible bands 29, 22 would remain the same. It should also be noted that although FIGS. 1 through 6 show a tapered conduit that has its smallest cross sectional area at the top, other shapes can be used for the tapered conduit 21 that create the same effects upon the flexible bands 29, 22 as does the embodiment shown. The tapered conduit may be formed with an hourglass shape, having its smallest cross sectional area close to its midsection. The tapered area above the narrowed midsection, creating the top half of the hourglass shape, could help the flexible bands 29, 22 engage the piston 9 at an angle slightly less than perpendicular. The acute angle orientation of the flexible bands 29, 22 against the piston 9 can keep the compression stresses on the flexible bands 29, 22 concentrated on the side of the bands 29, 22 that have depending side members. This orientation assures that the flexible bands 29, 22 will remain stiff and will not buckle in the wrong direction as the piston 9 is advanced by the flexible bands 29, 22. Thus, the best mode of the tapered conduit 21 is shown. It should be obvious that other formations of the tapered conduit can be used without effecting the function or novelty of the present invention.

With the effect of the tapered conduit 21 on the flexible formable band 22 now better understood, refer back to FIG. 1. The plunger 19 is accessed through the container orifice 13 by pressing the plunger base 15. The plunger 15 can be pressed to move from its rest position to an advanced position 31. The plunger has an edge 103. The edge 103 engages both bands 22 and 29 by coming in contact with side wall members 101, 105 and the their opposing dependant counterpart wall members. As the plunger 19 is pressed the engagement of the bands 29, 22 with the plunger 19, forces the bands 29, 22 to advance. The advancement of the bands 29, 22 causes more of the bands 29, 22 length to be forced through the tapered conduit 21. As the plunger 19 returns to its original position, it engages the next segment on the bands 29, 22 and the cycle is repeated. The return of the plunger 19 to its original position can be assisted through the use of a spring (not shown in this embodiment) that attaches the plunger 19 or the plunger base 15 to the container housing 7, the spring causing a bias to plunger 19 that is overcome by the force of an operator engaging the plunger 19 through the base orifice 13. The tops of the bands 29, 22 are attached to a piston 9, the advancement of the bands 29, 22 forward forces the piston 9 to advance. The new orientation of the bans 29, 22 prevents the bands 29, 22 from folding when pressed against the piston, thus the foldable bendable qualities of the bands 29, 22 that existed before entering the tapered conduit 21 are lost when exiting the tapered conduit 21.

Although the plunger 19 shown in FIG. 1 is activated through a base orifice 13, it should be understood that the plunger 19 can be advanced in ways other than so illustrated. An alternative means of advancing the plunger 19 may be accomplished through a set of wedges that engage the base of the plunger 19 on two sides. The wedges can be accessed through orifices on the sides of the container 7. As the wedges are pressed inward, the plunger 9 would follow the rise of the approaching slopes, thus being advanced upward, engaging the flexible bands 29, 22. Additionally, the plunger 19 can be advanced by numerous lever configurations or may ride upon a cam rotated by an outwardly extending knob. Although only the best mode embodiment of advancing the plunger 19 is illustrated, it should be understood that alternative embodiments can exist aside from the drawings shown and that the inventor of the present invention is entitled to protection of those alternative embodiments as outlined within the attached claims and specifications.

Figure 4:
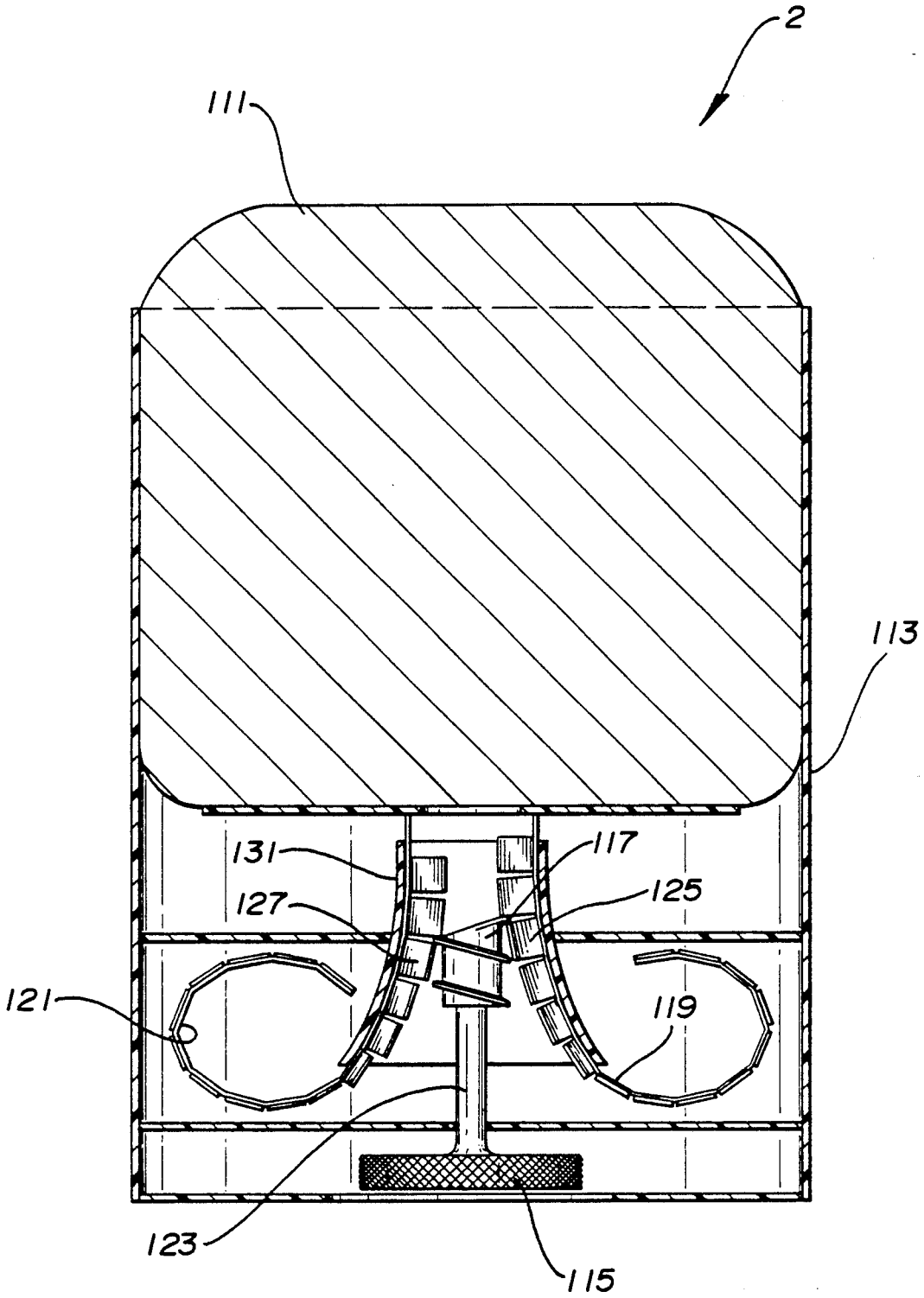
FIG. 4 shows a fragmented forward view of an alternative embodiment to the present invention.

Referring now to FIG. 4 an alternative embodiment 2 for the present invention is shown. This embodiment 2 shows the use of a threaded gear 117 to advance the bands 121 and 119. The threading on the gear 117 engages the bands 119, 121 as the side wall members 127, 125 are deformed forward by the squeezing action of the tapered orifice 131. The gear 117 is turned manually by a handle 115 at the bottom of the container 113 or may alternatively be turned by a side handle if another conversion gear is added to change the side turning action to a top turning action.

Figure 5:
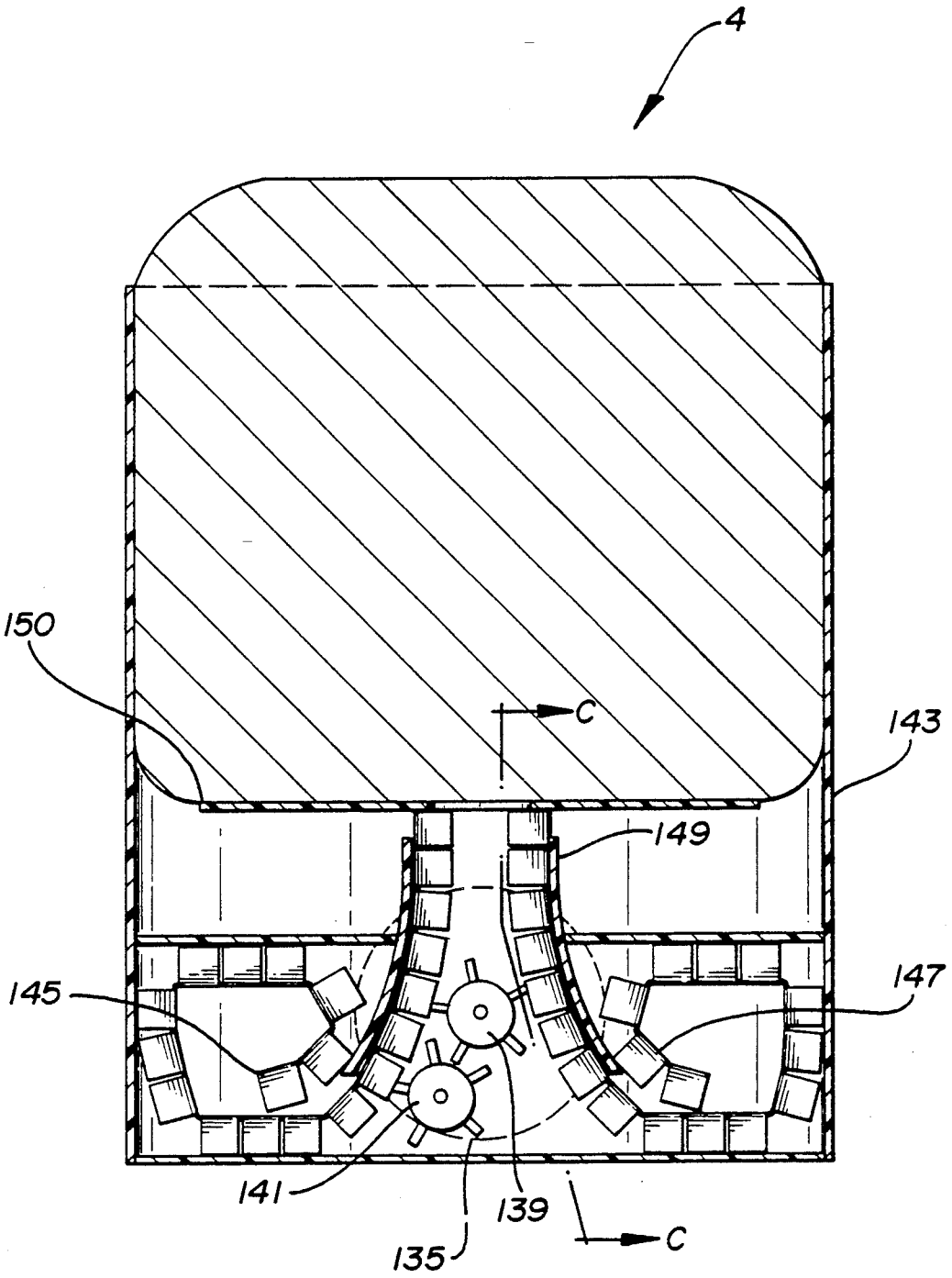
FIG. 5 shows a fragmented forward view of a second alternative embodiment to the present invention; and, FIG. 6 shows a fragmented front view of sectional cut C—C as indicated in FIG. 5.
Figure 6:
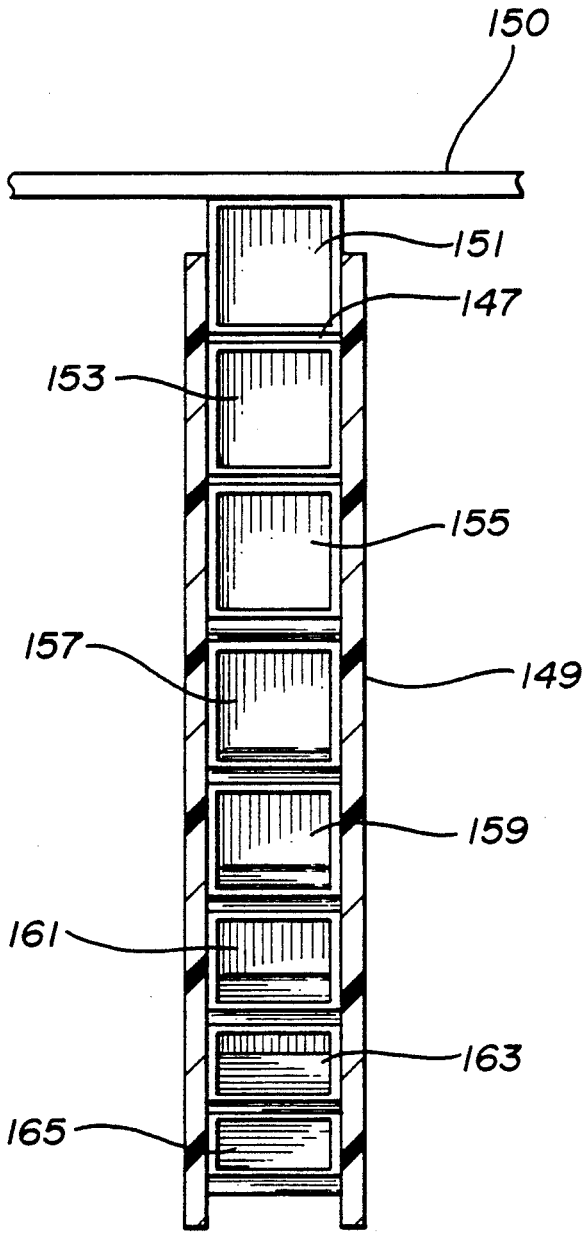

FIG. 5 shows an alternative embodiment for the bands 147, 145 and drive means of the present invention. The drive means is a plurality of gears comprising a drive gear 139 and a slave gear 141. The drive gear 139 being driven via a drive shaft that extends through the side wall of the container 143 and terminates with a turn handle 135. Both the drive gear 139 and the slave gear 141 engage their respective bands 147 and 145. The bands 147, 145 are best understood by referring first to FIG. 6 which depicts a front view of band 147 as it passes through conduit 149. As shown in FIG. 6, the band 147 is segmented into several connected sections 151, 153, 155, 157, 159, 161, 163, 165. Each section has four depending walls stemming from each edge of the sections. The conduit 149 orients the sections into a linear orientation (see sections 151, 153, 155, 157, 159), as the band 147 takes the shape of the conduit 149. As the band 147 exits the conduit 149 the band 147 is so oriented as to be perpendicular to the piston 150. As the band 147 is advanced against the piston 150 the band 147 is compressed. The resulting compression forces cause the adjacent side wall members of neighboring band sections to interfere with one another. The result is a band 147 that is rigid and will not flex or bend while the compression force is maintained.

Obviously, numerous modifications and variations of the present invention are possible in light of the above teachings. It is therefore understood that within the scope of the appended claims, the invention may be practiced otherwise than as specifically described herein, and that the specific shapes and orientations of the components shown in the drawings should not be considered the only embodiments of the invention.

What is claimed is:

1. An apparatus for storing and dispensing materials, said apparatus including:

a) a substantially hollow container having two ends, a dispensing end and a drive mechanism end, said dispensing end having at least one orifice for the exiting of material stored within said container;

b) at least one flexible band, said band having at least one front and rear surface, two side edges and two ends, said band having a plurality of side wall segments depending from at least one said side edge of said band, each said side wall segment being comprised of a substantially rigid member attached to said band by an interdepending flexible member, allowing said side wall segment to be elastically deformed into a plane substantially perpendicular to said band;

c) a piston attached to, and carried by at least one said flexible band;

d) a tapered conduit depending from said hollow container inner surface, said tapered conduit having two ends, an entrance end and an exit end, said tapered conduit narrowing to a width not substantially wider than said band, wherein the passage of said band through said conduit causes said band side wall segments to deform into an orientation substantially perpendicular to said band and causes said band to have a linear orientation substantially perpendicular to said piston; and e) a means of driving said band through said conduit, wherein said means engages at least one said band.

2. The apparatus of claim 1 wherein said tapered conduit is symmetrically formed as to change the orientation of said band side all segments on at least two said bands simultaneously.

3. The apparatus of claim 1 wherein said means of driving said band through said conduit is a moveable plunger, said plunger having at least one surface edge that engages at least one said band side wall segment when said plunger is advanced within said conduit, said plunger disengaging from said band side wall segment when said plunger retreats within said conduit.

4. The apparatus of claim 3 wherein said plunger is advanced within said conduit by being manually depressed, via an access orifice located within said drive mechanism end of said container.

5. The apparatus of claim 1 wherein said means of driving said band through said conduit is a threaded worm gear, said threaded worm gear having a helical thread that engages at least one said side wall segment of at least one said band, advancing at least on said band through said conduit as said threaded gear is rotated.

6. The apparatus of claim 5 wherein said threaded worm gear is rotated via a drive shaft that extends through said drive mechanism end of said container, said drive shaft being connected to a turnable handle.

7. The apparatus of claim 1 wherein said means of driving said band through said conduit is at least one spur gear, said spur gear having teeth that engage at least one said side wall segment of at least one said band.

8. The apparatus of claim 7 wherein at least one said spur gear is driven by a drive shaft that extends through the side of said container, said drive shaft terminating in a turnable handle.

9. An apparatus for storing and dispensing materials, said apparatus including:

a) a substantially hollow container having two ends, a dispensing end and a drive mechanism end, said dispensing end having at least one orifice for the exiting of material stored within said container;

b) at least one flexible band, said band having at least one front and rear surface, two side edges and two ends, said band having a plurality of substantially rigid receptacles formed on said front surface of said band, said receptacles being created by at least one wall segment which depends from, and is substantially perpendicular to said band, said wall segments creating the periphery of said receptacle, wherein each said receptacle along said band is connected by interdepending flexible members, the juxtaposition of said receptacles and said interdepending flexible members create said band, said receptacles having at least one wall segment that would engage an adjacent receptacle when said band is bent toward its front surface, the engagement of said receptacles preventing said band from bending forward substantially past a linear orientation;

c) a piston attached to, and carried by at least one said flexible band;

d) a tapered conduit depending from said hollow container inner surface, said tapered conduit having two ends, an entrance end and an exit end, wherethrough the passage of said band through said conduit causes said band to have a linear orientation substantially perpendicular to said piston; and e) a means of driving said band through said conduit, wherein said means engages at least one said band.

10. The apparatus of claim 9 wherein said tapered conduit is so formed as to orient said band exiting through said exit end of said tapered conduit so that said band intersects said piston at an acute angle, wherein said front surface of said band creates said acute angle with said piston.

11. The apparatus of claim 9 wherein said means of driving said band through said conduit is a threaded worm gear, said threaded worm gear having a helical thread that engages at least one said wall segment on at least one said band, advancing said band when said threaded worm gear is rotated.

12. The apparatus of claim 11 wherein said threaded worm gear is rotated via a drive shaft that extends through said drive mechanism end of said container, said drive shaft being connected to a turnable handle.

13. The apparatus of claim 9 wherein said means of driving said band through said conduit is at least one spur gear, said spur gear having teeth that engage at least one said wall segment of at least one said band.

14. The apparatus of claim 13 wherein at least one said spur gear is driven by a drive shaft that extends through the side of said container, said drive shaft terminating in a turnable handle.

* * * * *